US007223034B2

(12) United States Patent
Hiyama

(10) Patent No.: US 7,223,034 B2
(45) Date of Patent: May 29, 2007

(54) LIQUID PAINT COATER

(75) Inventor: Hiroshi Hiyama, Yokohama (JP)

(73) Assignee: SINWA Corporation, Kanagawa (JP)

( * ) Notice: Subject to any disclaimer, the term of this patent is extended or adjusted under 35 U.S.C. 154(b) by 333 days.

(21) Appl. No.: 10/483,183

(22) PCT Filed: Jun. 27, 2002

(86) PCT No.: PCT/JP02/06476

§ 371 (c)(1),
(2), (4) Date: Jan. 9, 2004

(87) PCT Pub. No.: WO03/007754

PCT Pub. Date: Jan. 30, 2003

(65) Prior Publication Data

US 2004/0168701 A1 Sep. 2, 2004

(30) Foreign Application Priority Data

Jul. 11, 2001 (JP) ..... 2001-211188

(51) Int. Cl.
*A46B 11/00* (2006.01)

(52) U.S. Cl. ..... 401/122; 401/121; 401/126; 401/127

(58) Field of Classification Search ..... 401/121, 401/122, 126, 127
See application file for complete search history.

(56) References Cited

U.S. PATENT DOCUMENTS 3,471,244 A * 10/1969 Melocchi ..... 401/122
4,627,454 A * 12/1986 Dahm ..... 401/126
4,930,919 A 6/1990 Gueret
5,052,837 A * 10/1991 Iizuka et al. ..... 401/126
5,349,972 A * 9/1994 Dirksing et al. ..... 401/122
5,597,254 A * 1/1997 Vasas ..... 401/122
5,791,800 A * 8/1998 Katz ..... 401/122
5,875,791 A * 3/1999 Sheffler et al. ..... 401/122

FOREIGN PATENT DOCUMENTS

JP 62-127214 U 8/1987
JP 62-127215 U 8/1987

* cited by examiner

*Primary Examiner*—Khoa D. Huynh
(74) *Attorney, Agent, or Firm*—Roberts, Mlotkowski & Hobbes, P.C.; Thomas W. Cole

(57) ABSTRACT

A liquid-cosmetic applicator is provided having a wiper formed on the inside of an elongated opening of a liquid-cosmetic container for scraping off the liquid cosmetic that adheres to the stem of a stemmed brush. The wiper includes at least two wiper domains that overlap along the longitudinal axis of said opening, each domain having a scraping section at one axial end, and a non-scraping section at an opposite end, the scraping sections being axially offset from one another and having sides that mutually engage along at least one interface. The interface provides a gap between said stem when said stem of said brush engages said scraping sections of said wiper domains that in turn defines an air passage that allows air to axially flow through said wiper as said stem is being wiped thereby eliminating unwanted suction forces when the applicator is withdrawn from the container.

7 Claims, 12 Drawing Sheets

LIQUID PAINT COATER

FIELD OF THE INVENTION

The invention relates to a liquid-cosmetic applicator such as a lip gross applicator and a mascara applicator, and more particularly to a liquid-cosmetic applicator having a wiper for scraping off the cosmetic that adheres to the stem of the applicator, the wiper formed inside an opening section of a liquid-cosmetic container for inserting the stemmed brush.

BACKGROUND OF THE INVENTION

As shown in FIG. 17, this type of liquid cosmetic applicator comprises a container 2 containing therein liquid cosmetic 1 and a stemmed brush 5 which has a cap 6 that can be fitted on an opening 3 of the container 2. Mounted on the outer periphery of the opening 3 of the container 2 is a wiper 4 formed of a flexible material such as a resin or rubber. The wiper 4 has a scraping section 4*a* adapted to scrape the cosmetic adhering to the stem 5*a* of the stemmed brush 5 off the stem 5*a* as the stemmed brush 5 is withdrawn out of (the opening 3) of the container 2. Portion 5*b* is a brush of the stemmed brush 5.

The inner diameter of the scraping section 4*a* is slightly smaller than the outer diameter of the stem 5*a* of the stem so that the scraping section 4*a* of the wiper 4 is in tight contact with the stem 5*a* of the stem, thereby scraping off the cosmetic adhering to the stem 5*a* of the stemmed brush 5. As a consequence, the pressure in the container 2 increases as the stemmed brush 5 is inserted into the container 2, which pressure can cause so-called pumping phenomena in which the cosmetic 1 in the container is pumped out or the stemmed brush 5 is pushed back. On the other hand, when the stemmed brush 5 is withdrawn, the pressure in the container 2 becomes negative, which causes an adverse resistive force on the stemmed brush 5, thereby hindering easy withdrawal of the stemmed brush 5 from the container 2.

To solve this problem, the wiper 4 is provided with a radially extending slit 4*a*1 formed in the scraping section 4*a* of the wiper 4 as shown in FIG. 18, so that, as the stemmed brush 5 is inserted into or withdrawn from the container 2, the air can pass through the slit 4*a*1 to balance the pressures of the air inside and outside the container to prevent the pumping phenomenon.

However, this second prior art configuration presents (FIG. 18) a problem that the slit 4*a*1 of the scraping section 4*a* leaves the cosmetic not scraped on the stem 5*a*.

In view of the problems pertinent to the prior art, it is an object of the present invention to provide a liquid-cosmetic applicator capable of avoiding pumping phenomena from occurring without hampering the function of the wiper.

SUMMARY OF THE INVENTION

In accordance with one aspect of the invention, as claimed in claim 1, there is provided a liquid-cosmetic applicator having a generally annular wiper formed on the inside of an opening of a liquid-cosmetic container for scraping off the liquid cosmetic that adheres to the stem of a stemmed brush, wherein:

The wiper has at least one axially offset region occupying a peripheral domain of the wiper and including a scraping section;

The offset region and a non-offset region share a joint section extending in the peripheral direction of the wiper; and The scraping sections of the offset and non-offset regions in the joint section overlap in the axial direction such that a gap is formed between, and along the inner peripheral surfaces of, the axially overlapping scraping sections, the gap extending in the axial direction.

(Function)

The stem of the stemmed brush has enhanced flexibility and better slidability in the axial direction against the wiper abutting against the stem, as compared with conventional wipers having no offset scraping section. This is because the inventive wiper includes at least one scraping section occupying a peripheral domain of the wiper is offset in the axial direction.

When the scraping sections of the wiper are in tight contact with the outer surface of the stem of the stemmed brush, a minute gap (air passage) that extends in the peripheral direction is formed along the axially overlapping scraping sections in tight contact with the outer surface of the stem. The gap serves as an air passage communicating with the upper and the lower spaces formed above and below the wiper, respectively.

Thus, when the stemmed brush is inserted into the container, it is in tight contact with the scraping sections, but the air in the container can escape therefrom to the outside of the container through the minute gap (air passage), thereby preventing the air pressure in the container from increasing. Hence no pumping phenomenon will occur.

On the other hand, when the stemmed brush is withdrawn from the container, the scraping sections of the wiper are in tight contact with the outer surface of the stem, thereby causing the scraping sections to scrape off the cosmetic adhering to the stem. Although the air passage formed along the inner peripheral surfaces of the axially overlapping scraping sections extends in the peripheral direction of the wiper and is in communication with the upper and the lower spaces of the wiper, the air passage is not open in the axial direction, so that the inner peripheral surfaces of the scraping sections are contiguous in the peripheral direction. Hence, there is no possibility that the scraping sections fail to scrape off the cosmetic adhering to the stem. It is noted that when the stemmed brush is withdrawn from the container, the scraping sections are in tight contact with the stem, but that (ambient) air can come into the container through the minute gap (air passage), so that the pressure in the container will never be negative and generate a resistive force acting on the withdrawing brush.

In a liquid-cosmetic applicator of the invention as defined in claim 2, the wiper has a cylindrical shape tapered in the direction from the opening to the inside of the container. Moreover, the wiper has a multiplicity of axially offset and non-offset regions distributed at substantially equal angular intervals about the axis, i.e. equal spacing in the peripheral direction, of the wiper, each region occupying a peripheral domain of the wiper and including a respective scraping section, the scraping sections in the respective regions overlapping in the axial direction.

(Function)

When the scraping sections of the wiper are in tight contact with the outer surface of the stem of the stemmed brush, the upper and lower spaces formed above and below the wiper, respectively, communicate with each other by the multiplicity of minute gaps (air passages) formed at substantially equal angular interval about the axis of the wiper in association with the multiple axially overlapping sections in tight contact with the stem. Thus, air can pass through the gaps quickly during insertion and withdrawal of the stemmed brush, creating no offset load of air pressure on either of the stemmed brush and the wiper.

A liquid-cosmetic applicator of the invention as defined in claim 3 has a wiper formed on the inside of the opening of a liquid-cosmeticcontainer for scraping off the cosmetic adhering to the stem of a stemmedbrush, wherein:

the wiper has a spiral scraping section that partly overlaps itself in the axial direction thereof, thereby resulting in overlapping portions to form a spiral gap between, and along the inner peripheral surfaces of, the axially overlapping portions.

(Function)

As compared with conventional wipers having concentric scraping sections, the wiper of the present invention having a spiral scraping section provides enhanced flexibility to the scraping section abutting on the stem of the stemmed brush, thereby providing the stemmed brush with better slidability in the axial direction.

When the scraping section of the wiper is in tight contact with the outer surface of the stem of the stemmed brush, a minute gap (air passage) is formed between the axially overlapping portions of the scraping section in contact with the outer surface of the stem, communicating with the upper and lower spaces formed above and below the wiper.

Thus, when the stemmed brush is inserted into the container, it is in tight contact with the scraping section, but the air in the container can escape therefrom to the outside of the container through the minute gap (air passage), thereby preventing the air pressure in the container from increasing. Hence no pumping phenomenon will occur.

On the other hand, when the stemmed brush is withdrawn from the container, the scraping section of the wiper is in tight contact with the outer surface of the stem, thereby causing the scraping section to scrape off the cosmetic adhering to the stem. The gap, formed along the inner peripheral surface of the axially overlapping scraping portions of the wiper for escapement of the air in the container, extends in the peripheral (i.e. spiral) direction, in communication with the spaces above and below the wiper. However, the inner peripheral surface of the scraping section of the wiper is continuous in the peripheral (i.e. spiral) direction, so that the scraping section will not fail to scrape off the cosmetic adhering to the stem. When the stemmed brush is withdrawn from the container, the scraping section is in tight contact with the stem, but that (ambient) air can come into the container through the minute gap (air passage), so that the pressure in the container will never be negative and generate a resistive force acting on the withdrawing brush.

BEST MODE FOR CARRYING OUT THE INVENTION

The invention will now be described in detail below.

Figure 1:
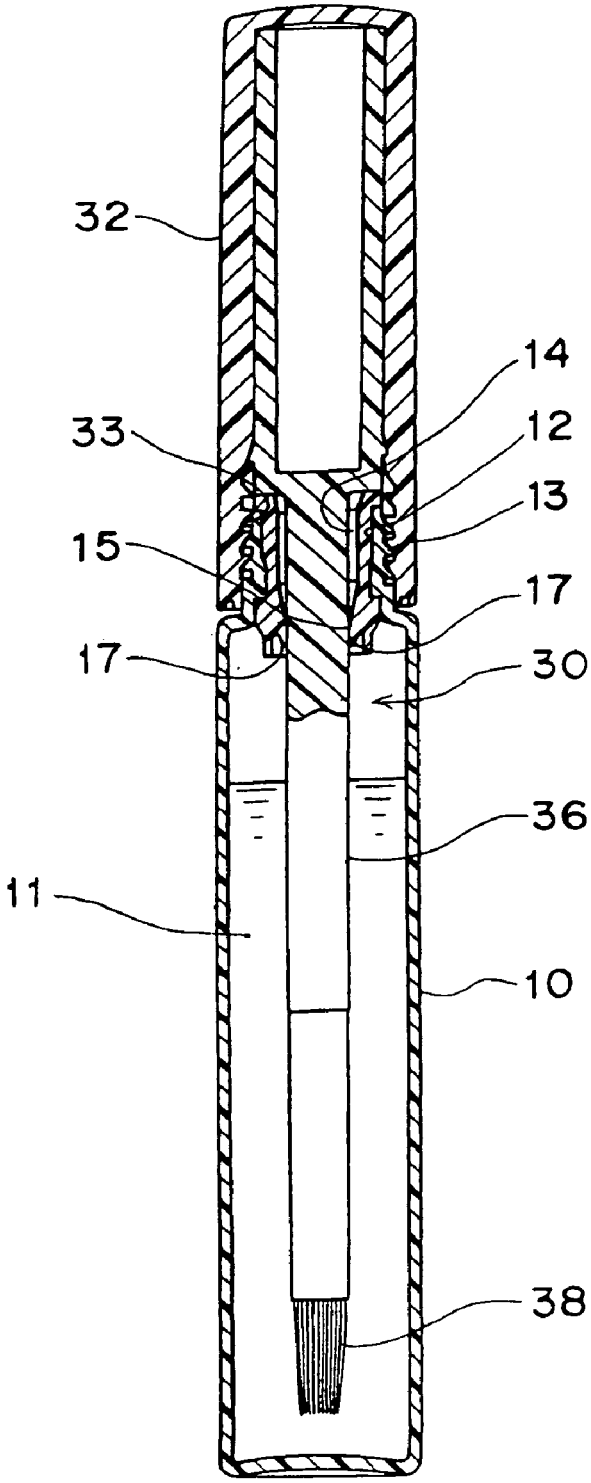
FIG. 1 is a longitudinal cross sectional view of a liquid-cosmetic applicator in accordance with one embodiment of the invention.
Figure 2:
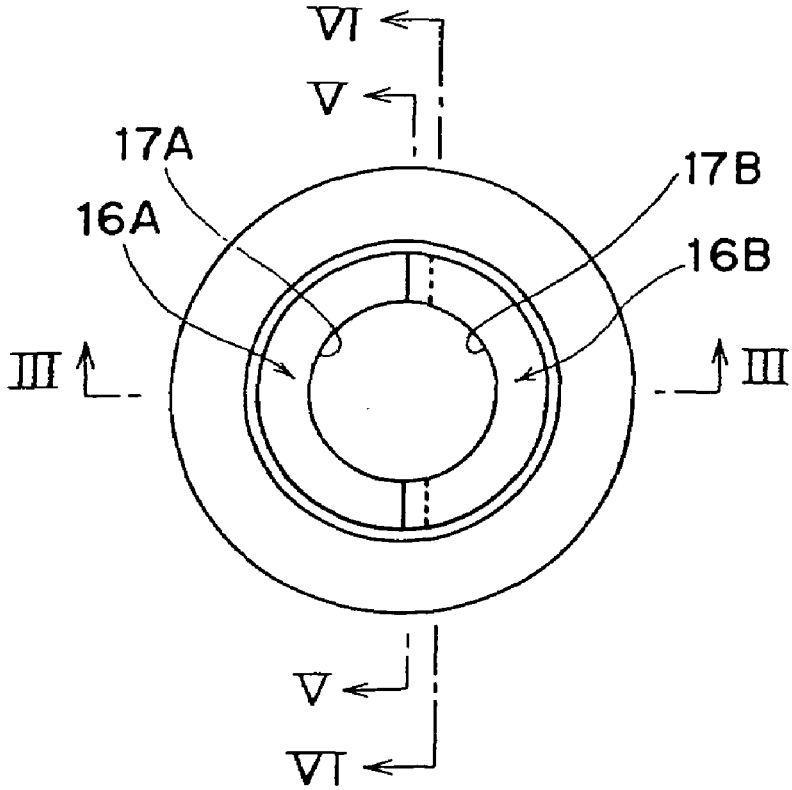
FIG. 2 is an enlarged plan view of a wiper of the cosmetic applicator of FIG. 1.
Figure 3:
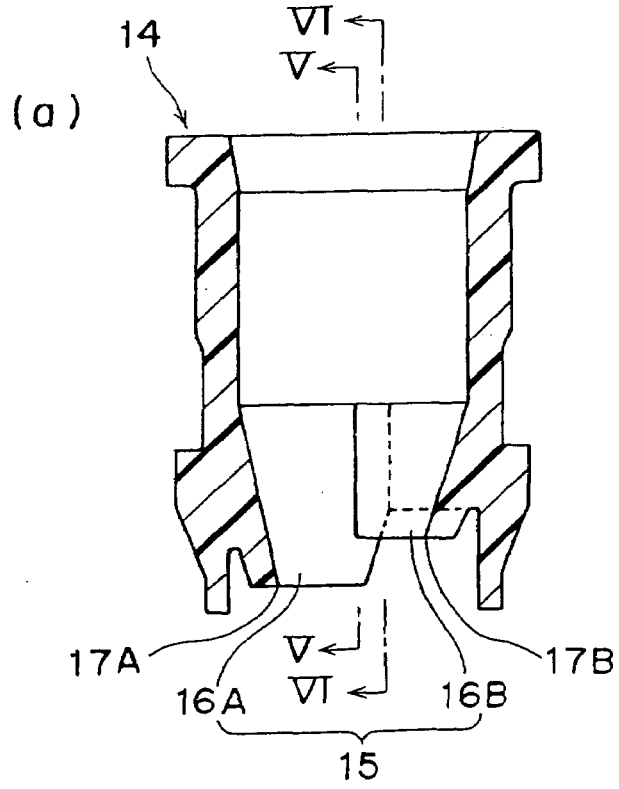
FIG. 3(*a*) is an enlarged longitudinal cross sectional view of the wiper, and FIG. 3(*b*) is a diagram illustrating the shape of the wiper.
Figure 3:
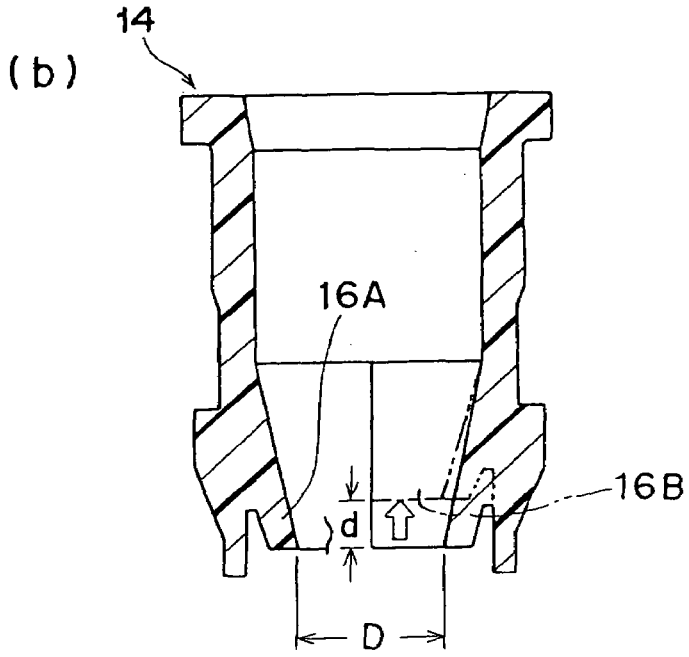
Figure 4:
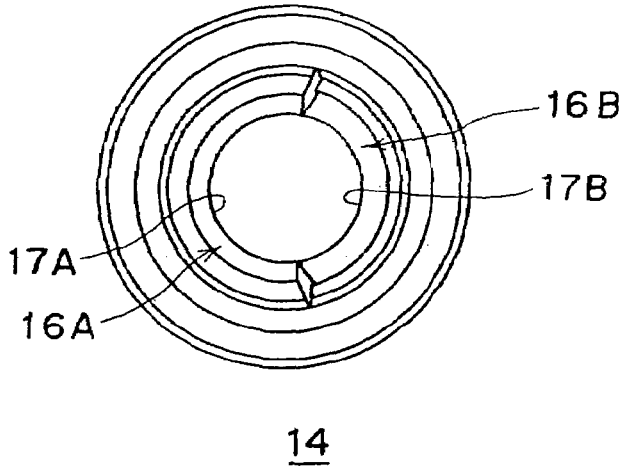
FIG. 4 is an enlarged bottom view of the wiper.
Figure 5:
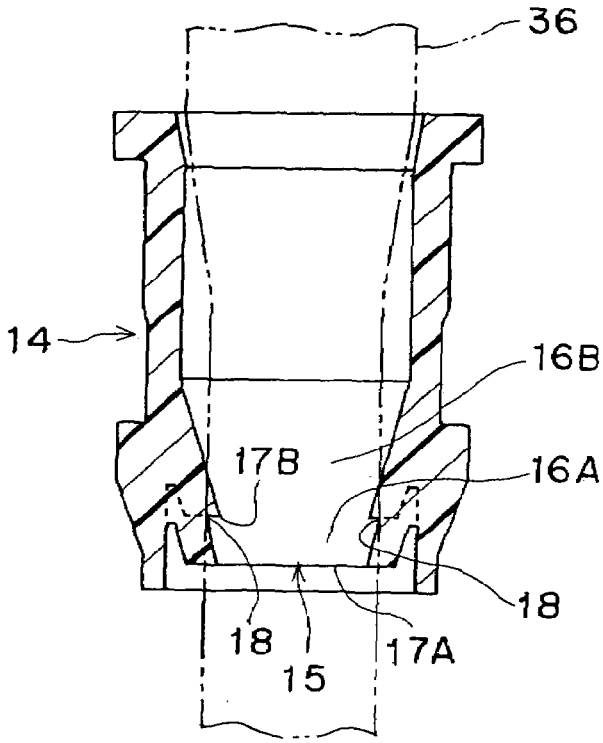
FIG. 5 is an enlarged longitudinal cross sectional view of the axially overlapping scraping sections the wiper taken along line V—V of FIG. 2 and FIG. 3(*a*).
Figure 6:
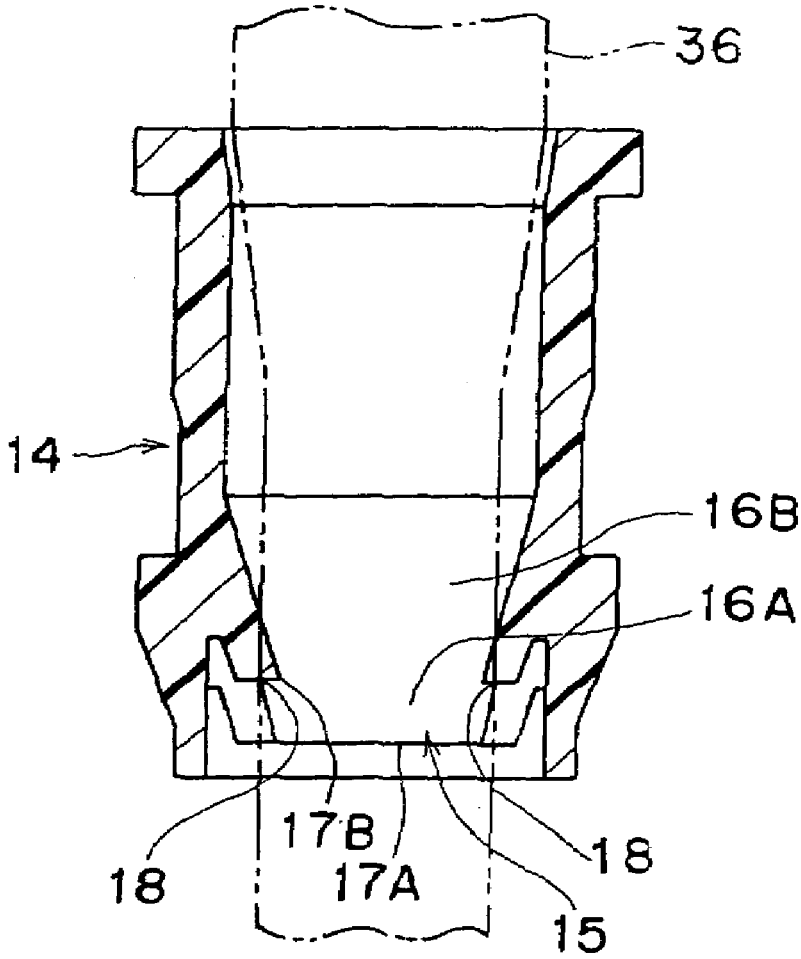
FIG. 6 is another enlarged longitudinal cross sectional view of the axially overlapping scraping sections of the wiper taken along line V—V of FIG. 2 and FIG. 3(*b*).
Figure 7:
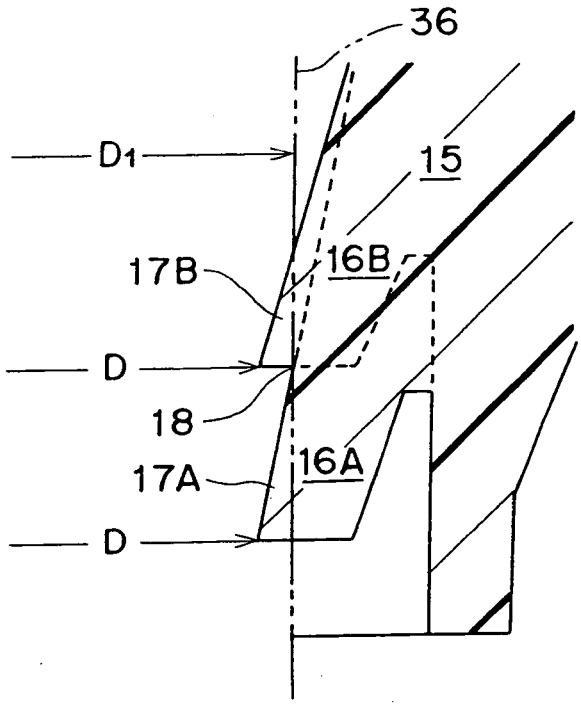
FIG. 7 is a still enlarged cross sectional view of the axially overlapping scraping sections.
Figure 8:
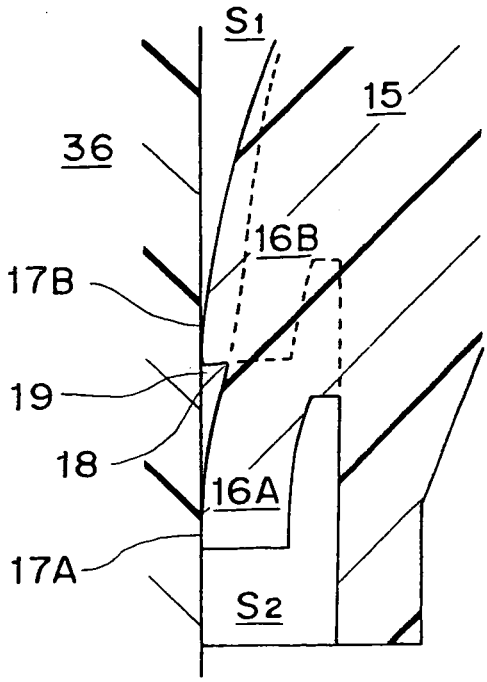
FIG. 8 is a cross sectional view of a minute gap (air passage) formed between the external surface of the stem of a stemmed brush and the internal peripheral surfaces of the axially overlapping scraping sections.
Figure 9:
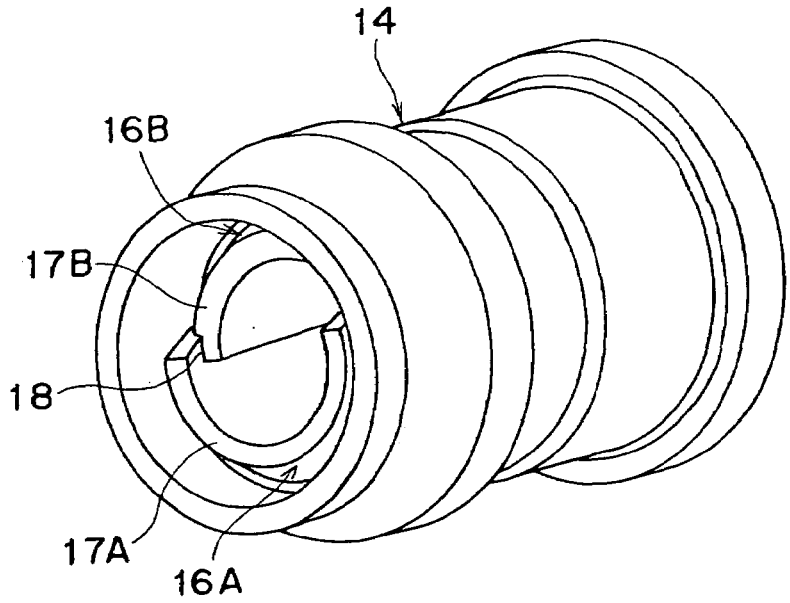
FIG. 9 is an enlarged partial perspective view of the wiper, showing a portion of the wiper having scraping sections.
Figure 10:
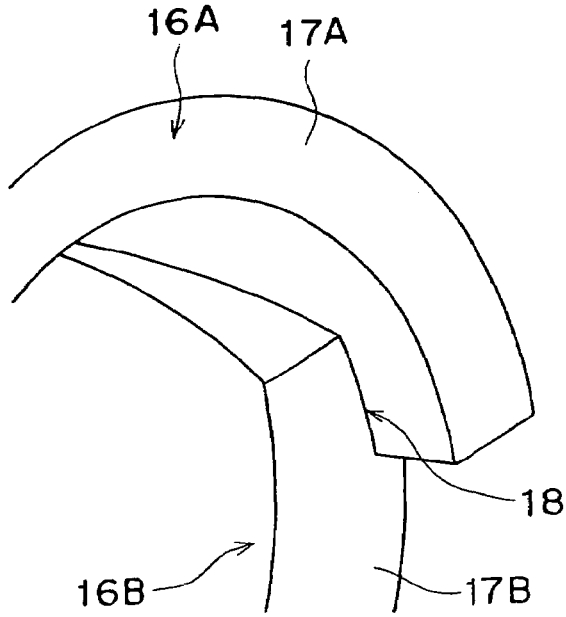
FIG. 10 is an enlarged perspective view of the wiper, showing axially overlapping scraping sections of the wiper.

FIGS. 1–10 show a first embodiment of the invention as defined in claim 1. More specifically, FIG. 1 is a longitudinal cross sectional view of a liquid-cosmetic applicator in accordance with one embodiment of the invention. FIG. 2 is an enlarged plan view of a wiper of the cosmetic applicator of FIG. 1. FIG. 3(*a*) is an enlarged longitudinal cross sectional view of the wiper, and FIG. 3(*b*) is a diagram illustrating the shape of the wiper. FIG. 4 is an enlarged bottom view of the wiper. FIG. 5 is an enlarged longitudinal cross sectional view of the axially overlapping scraping sections the wiper taken along line V—V of FIG. 2 and FIG. 3(*a*). FIG. 6 is another enlarged longitudinal cross sectional view of the axially overlapping scraping sections of the wiper taken along line V—V of FIG. 2 and FIG. 3(*b*). FIG. 7 is a still enlarged cross sectional view of the axially overlapping scraping sections. FIG. 8 is a cross sectional view of a minute gap (air passage) formed between the external surface of the stem of a stemmed brush and the internal peripheral surfaces of the axially overlapping scraping sections. FIG. 9 is an enlarged partial perspective view of the wiper, showing a portion of the wiper having scraping sections. FIG. 10 is an enlarged perspective view of the wiper, showing axially overlapping scraping sections of the wiper.

As shown in these figures, a cosmetic container 10 has a shape of an elongate cylinder for containing therein a lip gross liquid 11 and has an opening 12 at the upper end thereof for inserting there through a stemmed brush smaller in diameter than the inner diameter of the container 10. Formed on the outer periphery of the opening 12 is an external thread that can be mated with the internal thread 33 formed on a cap 32. The cap 32 is integral with the stem 30 of the stemmed brush.

On the other hand, mounted on the inside of the opening 12 is a cylindrical internal lid 14 made of an elastic resin. The internal lid 14 has an portion extending into the container 10. The internal lid 14 has, near the lower end thereof and on the inside thereof, a wiper 15 for scraping off the lip gross liquid 11 adhering to the stem 36 of the stemmed brush 30 to provide an appropriate amount of the lip gross liquid 11 on the brush 38 as the stemmed brush 30 is withdrawn from the container 10. That is, the wiper 15 has a generally cylindrical shape with its diameter gradually decreasing towards the tip thereof. The wiper extends from the inside of the internal lid 14 in an oblique downward direction, with the tip thereof configured to form a scraping section 17 for scraping off the lip gross liquid staying on the outer surface of the stem 36.

As shown in FIG. 3(*b*) by a solid line, the end of the generally cylindrical wiper 15 having inner diameter D comprises a first semi-cylindrical wiper domain 16A that is offset in the axial direction by a distance d and has a larger axial extension (as indicated by an arrow) and a second semi-cylindrical wiper domains 16B axially not offset and having a smaller extension. The wiper domains 16A and 16B are integrated at their peripheral edge regions (the integrated peripheral edge regions referred to as joint section). The scraping sections 17A and 17B of the first and the second wiper domains 16A and 16B, respectively, overlap in the axial direction in the joint section, as shown in FIGS. 3(*a*), 5, and 6. Formed between, and extending along the inner peripheral surfaces of, the axially overlapping two scraping sections 17A and 17B in the joint section is a step or gap 18 extending in the peripheral direction. Thus, a minute gap (air passage) 19 is formed between the outer surface of the stem 36 of the stemmed brush 30 inserted in the container 10 and the inner peripheral surface of the axially overlapping scraping sections, which gap extends in the peripheral direction to communicate with an upper and a lower annular spaces S1 and S2 above and below the wiper 15, respectively, as shown in FIG. 8.

Figure 18:
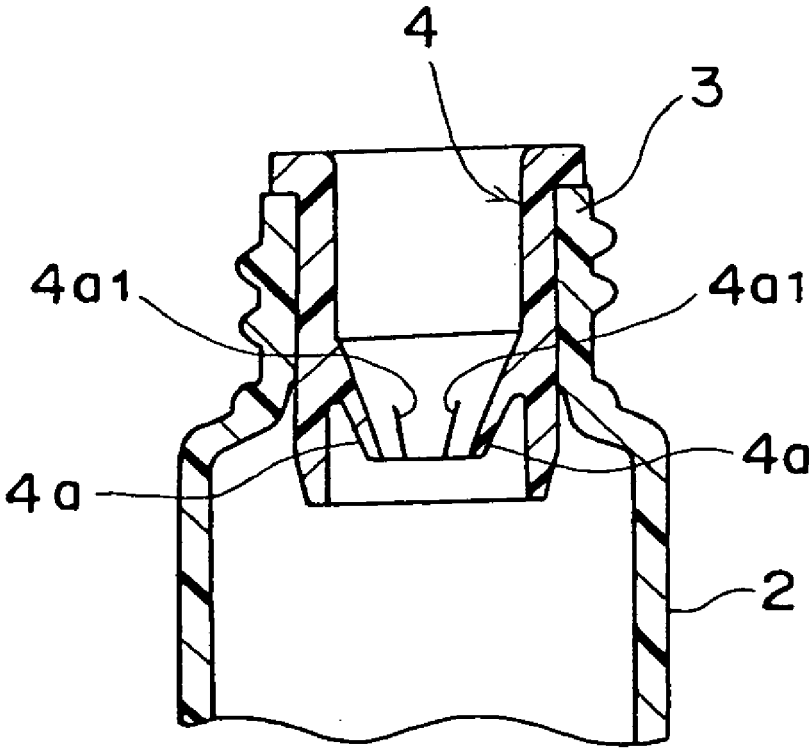
FIG. 18 is an enlarged cross sectional view of a second prior art liquid-cosmetic applicator.

FIG. 7 shows the physical relationship between the first and the second axially overlapping scraping sections 17A and 17B, respectively, and the outer surface of the stem 36 of the stemmed brush inserted in the container 10. As seen in FIG. 7, the inner diameter D of the first and second scraping sections 17A and 17B, respectively, is slightly smaller than the outer diameter D1 of the stem 36 of the stemmed rush. Therefore, the first and the second scraping sections 17A and 17B, respectively, are resiliently deformed in the radial outward direction as the stemmed brush is inserted into the container 10. They are then in tight contact with the outer surface of the stem 36 of the stemmed brush. The minute gap (air passage) 19 is defined by the inner peripheral surfaces of the scraping sections of the wiper and the outer surface of the stem 36 of the stemmed brush, as shown in FIG. 18. The upper and lower spaces S1 and S2 above and below the wiper 15, respectively, communicate with each other via the minute gap (air passage) 19.

As a consequence, when the stemmed brush 30 is inserted into the container 10, the stem 36 is in tight contact with the scraping sections of the wiper 15, but the air in the container is allowed to escape therefrom via the minute gap (air passage) 19, thereby relieving the air pressure in the container and preventing the pumping phenomenon.

When the stemmed brush 30 is withdrawn from the container 10, the scraping sections of the wiper is also in tight contact with the outer surface of the stem 36 that the scraping sections of the wiper scrape the liquid lip gross off the stem 36. The scraping sections 17A and 17B are offset in the axial direction by a distance d and the two scraping sections are not contiguous. However, they overlap in the joint section of the first and second wiper domains 16A and 16B, respectively, such that the scraping sections 17A and 17B are contiguous in the peripheral direction of the wiper. As a result, the entire outer surface of the stem 36 of the stemmed brush 30 is uniformly scraped by the scraping sections 17A and 17B, thereby leaving no liquid lip gross on the stem 36.

It should be appreciated that the stemmed brush 30 is withdrawn from the container 10 with the scraping sections 17A and 17B of the wiper in tight contact with the outer surface of the stem 36, but that (ambient) air can come into the container 10 through the minute gap (air passage) 19 formed between the outer surface of the stem 36 and the axially overlapping scraping sections, so that the pressure in the container 10 will never be negative or generate a resistive force acting on the withdrawing brush 30. As a result, the stemmed brush 30 can be smoothly withdrawn from the container 10.

In the example shown herein, axially overlapping sections of the wiper 15 may be provided at two evenly spaced peripheral domains of the wiper, so that two air passages 19 may be provided at two equally spaced peripheral domains of the wiper in association with the scraping sections 17A and 17B. As a consequence, smooth and quick supply and removal of air to and from the container 10 may be attained without creating any offset load on either of the stemmed brush 30 and the internal lid 14, thereby allowing smooth insertion and withdrawal of the stemmed brush 30.

Figure 11:
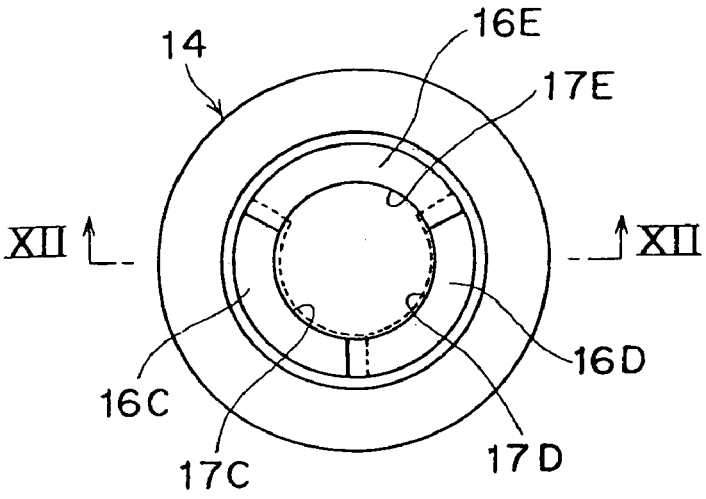
FIG. 11 is an enlarged plan view of the wiper of a liquid-cosmetic applicator in accordance with a second embodiment of the invention.
Figure 12:
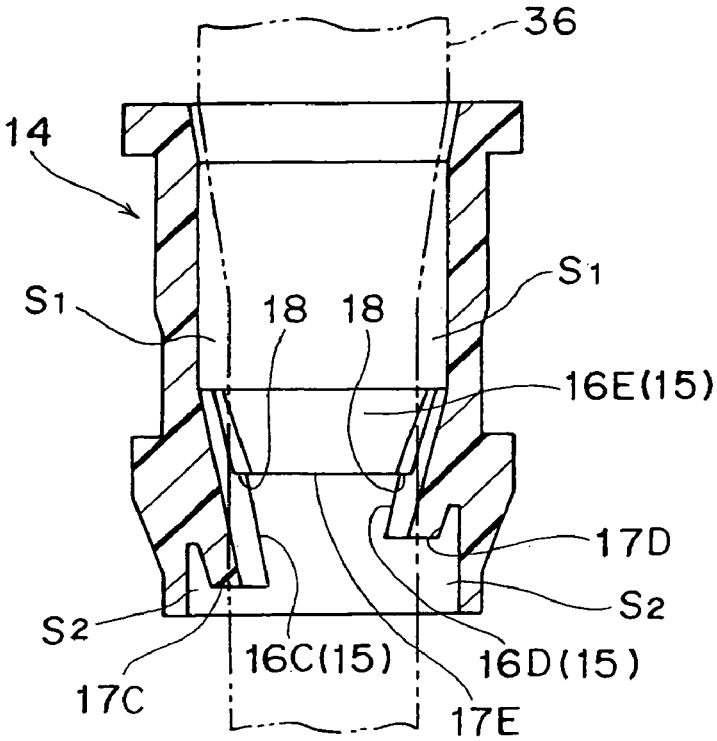
FIG. 12 is a longitudinal cross sectional view of the wiper taken along line XH—XH of FIG. 11.

Referring to FIGS. 11 and 12, there is shown a second embodiment of a liquid-cosmetic applicator according to the invention. FIG. 11 is an enlarged plan view of the wiper which is a main portion of the liquid-cosmetic applicator. FIG. 12 is a longitudinal cross sectional view of the wiper taken along line XH—XH of FIG. 11.

Like the first embodiment having the scraping sections 17A and 17B, the leading end of the tapered cylindrical wiper of the second embodiment has an inner diameter D and is divided into a first through a third wiper domains 16C–16E each occupying a substantially ⅓ peripheral domain of the tapered end of the wiper. They are sequentially offset by a distance d in the axial direction, as shown in FIG. 3(*b*). Each of the lowest (first) wiper domain 16C, the middle (second) wiper domain 16D, and the uppermost (third) wiper domain 16E has an edge section integral with the one neighboring in the peripheral direction. These edge sections will be referred to as joint sections. Each of the scraping sections 17C–17E belonging to the respective wiper domains overlaps the neighboring one in the axial direction. Three gaps 18 are formed between, and along the respective inner peripheral surfaces of, the axially overlapping scraping sections in the three peripheral domains.

In the example shown herein, because the air passages 18 are formed in the three peripheral regions of the wiper in communication with the spaces S1 and S2 above and below the wiper 15, respectively, still smoother and quicker supply and removal of air to and from the container is attained while inserting and withdrawing the stemmed brush 30 into and out of the container 30, thereby creating no offset load on either of the stem 36 of the stemmed brush 30 and the wiper 15 and permitting smooth insertion and removal of the stemmed brush 30.

Figure 13:
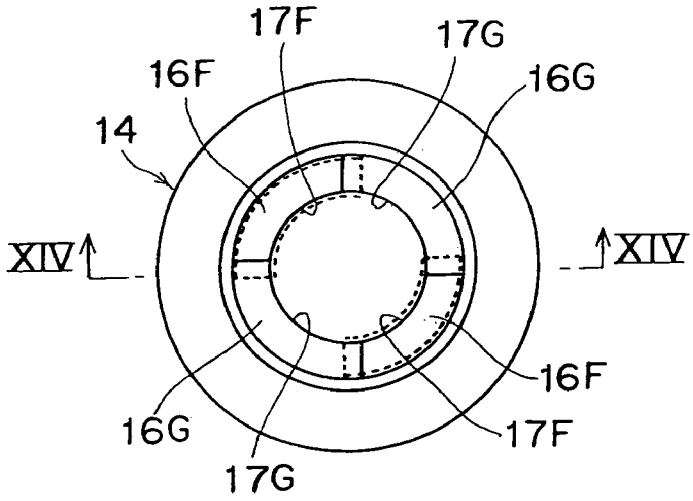
FIG. 13 is an enlarged plan view of a wiper of a liquid-cosmetic applicator in accordance with a third embodiment of the invention.
Figure 14:
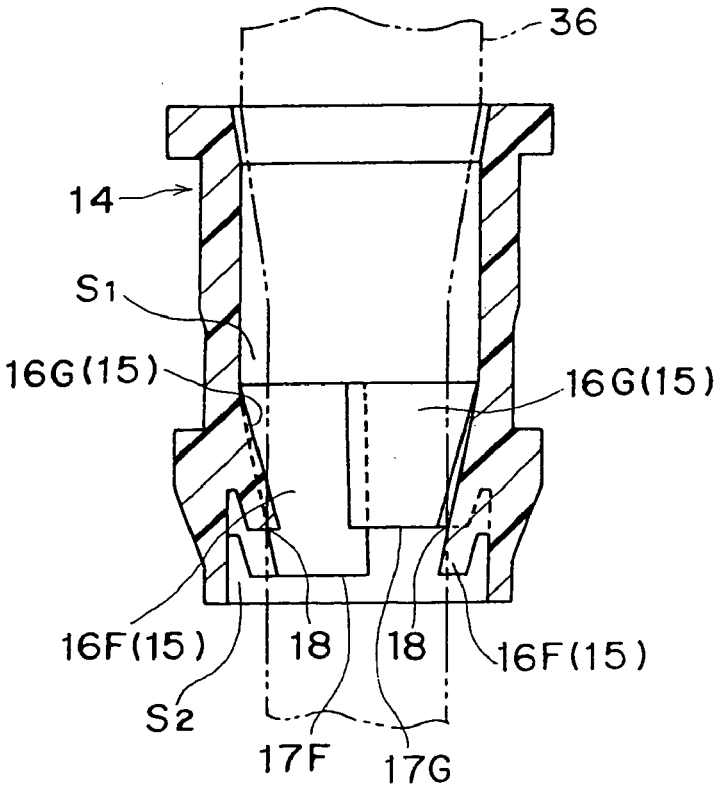
FIG. 14 is a longitudinal cross sectional view of the wiper taken along line XIV—XIV of FIG. 13.

Referring to FIGS. 13 and 14, there is shown a third embodiment of a liquid-cosmetic applicator according to the invention. FIG. 13 is an enlarged plan view of a wiper of the liquid-cosmetic applicator. FIG. 14 is a longitudinal cross sectional view of the wiper taken along line XIV—XIV of FIG. 13.

Like the scraping sections 17A and 17B of the first embodiment, the leading end of the tapered cylindrical wiper of the third embodiment has an inner diameter D and is angularly divided into four regions occupying substantially equal peripheral domains of the wiper (the regions referred to as peripheral regions) in such a way that they are alternately offset in the axial direction by a distance d as shown in FIG. 3(*b*), and each integrally joined at the opposite edged thereof with neighboring ones in the peripheral direction, forming joint sections. In these joint sections, the scraping sections of the neighboring wiper domains overlap each other in the axial direction. Four gaps are formed along the inner peripheral surfaces of the axially overlapping scraping sections in the four peripheral regions.

The scraping section 17F of the opposing lower (first) wiper domains 16F and the scraping section 17G of the opposing upper (second) wiper domains 16G overlap in the respective joint sections to form gaps 18 serving as air passages in communication with the spaces S1 and S2 formed above and below the wiper 15, respectively.

In the example shown herein, because the air passages 18 are formed in the four peripheral regions in communication with the spaces S1 and S2 above and below the wiper 15, respectively, still smoother and quicker supply and removal of air to and from the container is attained while inserting and withdrawing the stemmed brush 30 into and out of the container 30, thereby creating no offset load on either of the stem 36 of the stemmed brush 30 and the wiper 15 and permitting smooth insertion and withdrawal of the stemmed brush 30.

Figure 15:
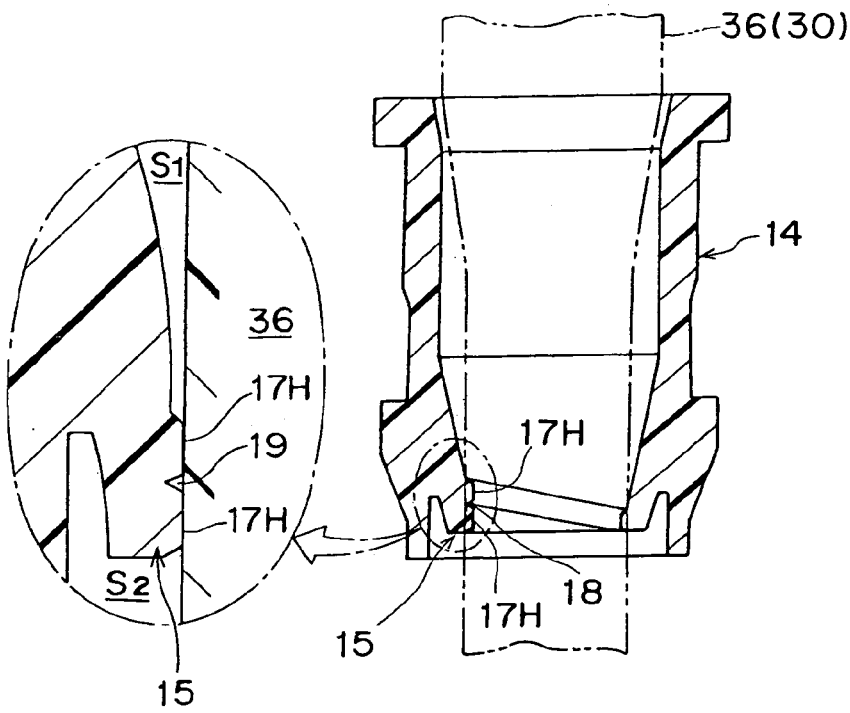
FIG. 15 is an enlarged longitudinal cross sectional view of the wiper of a liquid-cosmetic applicator in accordance with a first embodiment of the invention as defined in claim 3.
Figure 16:
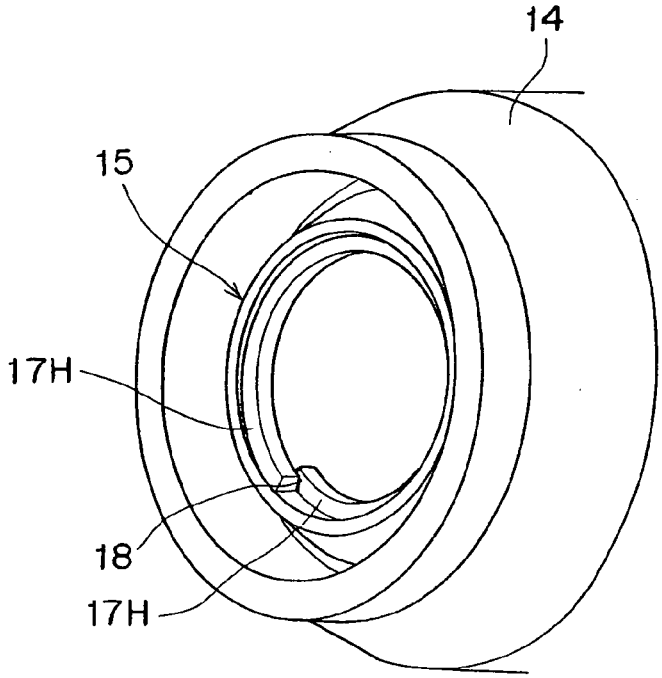
FIG. 16 is an enlarged partial perspective view of the wiper of FIG. 15, showing the scraping section of the wiper.
Figure 17:
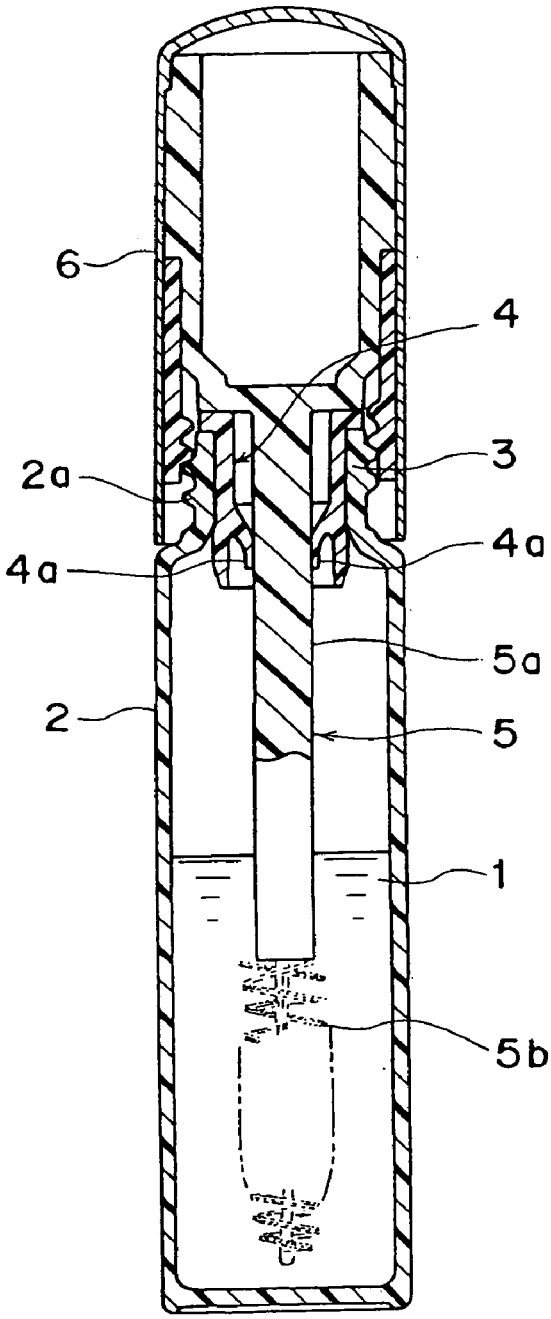
FIG. 17 is a cross sectional view of a first prior art liquid-cosmetic applicator.

FIGS. 15 and 16 illustrates a liquid-cosmetic applicator in accordance with a first embodiment of the invention as defined in claim 3. FIG. 15 shows an enlarged longitudinal cross section of the wiper, which is a major portion of the applicator. FIG. 16 is an enlarged perspective view of the scraping section of the wiper and its vicinity.

In contrast to the first through the third embodiments of the invention (as defined in claim 1) in which the scraping sections of the wiper 15 are partly offset in the axial direction in such a away that one scraping section axially overlaps another in the joint section, the wiper 153 is provided with a spiral scraping section 17H that has axially overlapping portions 17H, 17H to form a spiral gap 18 between, and along the inner peripheral surfaces of, the axially overlapping portions 17H,17H. In the example shown herein, elements of the applicator other than the inner lid 14 and the wiper 15, such as container 10 and the stemmed brush 30, have the same structure as those of the first through third embodiments according to claim 1. Hence, details of these elements will be omitted here.

When the spiral scraping section 17H of the wiper is in tight contact with the outer surface of the stem 36 of the stemmed brush 30, a minute spiral gap 18 is formed along the axially overlapping portions of the spiral scraping section 17H in tight contact with the outer surface of the stem 36. The gap serves as a minute air passage 19 communicating with the spaces S1 and S2 above and below the wiper, respectively.

Thus, when the stemmed brush 30 is inserted into the container 10, the outer surface of the stem 36 of the stemmed brush 30 is in tight contact with the spiral scraping section 17H. But the air in the container 10 is allowed to escape from the container 10 through the minute spiral air passage 19, thereby preventing the air pressure in the container from increasing. Hence, no pumping phenomenon will occur.

On the other hand, when the stemmed brush 30 is withdrawn from the container 10, the scraping section 17H of the wiper is in tight contact with the outer surface of the stem 36, thereby causing the scraping section 17H of the wiper 15 to scrape off the liquid lip gross adhering to the stem 36. Although the air passage 18 extends in the spiral direction and communicates with the upper space S1 above the wiper 15 and the lower space S2 below the wiper 15, the inner peripheral surface of the scraping section 17H is continuous in the peripheral (spiral) direction, so that there is no risk that the scraping section fails to scrape off the cosmetic adhering to the stem.

When the stemmed brush 30 is withdrawn from the container 10, the scraping section 17H of the wiper 15 is in tight contact with the outer surface of the stem, But (ambient) air can flow into the container 10 through the minute air passage 19 formed between the outer surface of the stem and the axially overlapping scraping portions. Consequently, the pressure in the container 10 will never be negative or generate a resistive force acting on the withdrawing brush 30.

Although the invention has been described above with a particular reference to an applicator for use with a lip gross cosmetic, a person skilled in the art will understand that the invention applicable equally well to other cosmetic applicators including mascara applicators.

INDUSTRIAL UTILITY OF THE INVENTION

It will be apparent from the foregoing description that a liquid-cosmetic applicator according to the invention as defined in claim 1 provides enhanced flexibility of the scraping sections of a wiper, which in turn provides improved slidability of the stem in the axial direction, thereby permitting easy insertion and withdrawal of the stemmed brush into and from the container.

The invention eliminates a pumping phenomenon that causes various kinds of problems.

In addition, the invention prevents the air pressure in the container from having a negative pressure that results in a resistive force that acts on the stemmed brush. Hence, the stemmed brush can be smoothly withdrawn from the container, so that the applicator can be easily handled.

The cosmetic adhering to the stem of the stemmed brush can be completely scraped off from the stem as the brush is withdrawn from the container, since continuous inner peripheral surfaces of the scraping sections of the wiper are in tight contact with the outer surface of the stem.

When the stemmed brush is inserted into or withdrawn from the container, the wiper of the present invention as defined in claim 2 creates no offset load on either of the stemmed brush and the wiper. In addition, air can be quickly injected into or ejected from the container through minute gaps, thereby facilitating smooth insertion and withdrawal of the brush.

A liquid-cosmetic applicator of the invention as defined in claim 3 provides enhanced flexibility of the wiper of a liquid-cosmetic applicator, which in turn provides improved slidability of the stemmed brush in the axial direction, thereby facilitating smooth insertion and withdrawal of the brush into and from the container.

In this arrangement, no pumping phenomenon, and hence various problems pertinent thereto also, take place during insertion of the stemmed brush into the container.

In addition, the air pressure in the container will never be negative during withdrawal of the stemmed brush from the container, so that the brush may be easily withdrawn, making it easy to handle the applicator.

When the stemmed brush is withdrawn, the outer surface of the stem of the stemmed brush is in tight contact with the continuous spiral internal surface of the scraping section of the wiper, which enables complete scraping of the cosmetic that adheres to the stem of the stemmed brush.

The invention claimed is:

1. A liquid-cosmetic applicator having a wiper formed on the inside of an elongated opening of a liquid-cosmetic container for scraping off the liquid cosmetic that adheres to the stem of a stemmed brush, said wiper comprising:

at least two wiper domains that overlap along the longitudinal axis of said opening, each domain having a scraping section at one axial end, and a non-scraping section at an opposite end, said scraping sections being axially offset from one another and having sides that mutually engage along at least one interface, wherein said interface defines a gap between said stem when said stem of said brush engages said scraping sections of said wiper domains that in turn defines an air passage that allows air to axially flow through said wiper as said stem is being wiped.

2. The liquid-cosmetic applicator of claim 1, wherein said non-scraping sections of said wiper domains terminate in edges, and said edges of said non-scraping sections are axially aligned with one another.

3. The liquid-cosmetic applicator of claim 1, Wherein said wiper includes only two wiper domains.

4. The liquid-cosmetic applicator of claim 1, wherein said interface between said side walls is axially aligned.

5. The liquid-cosmetic applicator of claim 1, wherein the axial length of one of said wiper domains is different from the axial length of the other wiper domain.

6. The liquid-cosmetic applicator of claim 1, wherein said wiper domains are frustro-conical, and said stem is substantially cylindrical.

7. The liquid-cosmetic applicator of claim 1, wherein the circumferential extent of said wiper domains is substantially equal.

* * * * *